US012006114B2

(12) United States Patent
Minnette et al.

(10) Patent No.: US 12,006,114 B2
(45) Date of Patent: Jun. 11, 2024

(54) TETHERED CAP AND SPOUT

(71) Applicant: Nypro Inc., Clinton, MA (US)

(72) Inventors: Jeffrey C. Minnette, St. Petersburg, FL (US); Ryan P. Davidson, St. Petersburg, FL (US); Pau Mauri Pinol, Tortosa (ES); Randall K. Julian, Oakland City, IN (US)

(73) Assignee: Nypro Inc., Clinton, MA (US)

( * ) Notice: Subject to any disclaimer, the term of this patent is extended or adjusted under 35 U.S.C. 154(b) by 301 days.

(21) Appl. No.: 17/618,025

(22) PCT Filed: Jun. 10, 2020

(86) PCT No.: PCT/US2020/036945
§ 371 (c)(1),
(2) Date: Dec. 10, 2021

(87) PCT Pub. No.: WO2020/251984
PCT Pub. Date: Dec. 17, 2020

(65) Prior Publication Data

US 2022/0315302 A1 Oct. 6, 2022

(30) Foreign Application Priority Data

Jun. 10, 2019 (ES) ..... ES201930525

(51) Int. Cl.
*B65D 55/16* (2006.01)
*B65D 47/08* (2006.01)
(Continued)

(52) U.S. Cl.
CPC ..... *B65D 55/16* (2013.01); *B65D 47/0842* (2013.01); *B65D 47/122* (2013.01); *B65D 51/22* (2013.01); *B65D 55/06* (2013.01)

(58) Field of Classification Search
CPC .. B65D 55/16; B65D 47/0842; B65D 47/122; B65D 51/22; B65D 55/06
(Continued)

(56) References Cited

U.S. PATENT DOCUMENTS 5,141,133 A 8/1992 Ninomiya et al.
5,927,527 A * 7/1999 Montgomery ..... B65D 50/046 D9/453

(Continued)

FOREIGN PATENT DOCUMENTS

CN 1655991 A 8/2005
CN 1662422 A 8/2005

(Continued)

*Primary Examiner* — Paul R Durand
*Assistant Examiner* — Michael J. Melaragno
(74) *Attorney, Agent, or Firm* — Young Basile Hanlon & MacFarlane, P.C.

(57) ABSTRACT

Disclosed herein are tethered cap and spout combinations. The tethered cap and spout combinations prevent loss of the cap after opening. In an implementation, the tethered cap and spout combinations may provide mechanisms for puncturing or opening a seal that may be present at a throat or neck of the container which provides both an anti-tampering and freshness function. In an implementation, the tethered cap and spout combinations may provide anti-tampering mechanisms. In an implementation, the tethered cap and spout combinations may provide mechanisms to hold an opened and tethered cap away from the container opening during use.

20 Claims, 22 Drawing Sheets

(51) Int. Cl.
*B65D 47/12* (2006.01)
*B65D 51/22* (2006.01)
*B65D 55/06* (2006.01)

(58) Field of Classification Search
USPC ..... 220/277
See application file for complete search history.

(56) References Cited

U.S. PATENT DOCUMENTS 6,474,491 B1 11/2002 Benoit-Gonin et al.
6,851,576 B2 * 2/2005 Dubach ..... B65D 5/748 220/277
7,959,032 B2 * 6/2011 Bolli ..... B65D 5/748 222/93
7,997,436 B2 * 8/2011 Bolli ..... B65D 5/748 215/297
8,469,213 B2 * 6/2013 Ishii ..... B65D 41/3428 220/837
11,780,659 B2 * 10/2023 Gauxachs ..... B65D 47/0857 215/237
2008/0210745 A1 * 9/2008 Rigling ..... B65D 5/748 229/125.24
2010/0320209 A1 * 12/2010 Leuenberger ..... B65D 5/748 220/284
2011/0114593 A1 * 5/2011 Ishii ..... B65D 41/325 215/253
2012/0181281 A1 * 7/2012 Ott ..... B65D 5/748 220/277
2013/0043260 A1 * 2/2013 Barron ..... B65D 5/748 220/694
2013/0193146 A1 8/2013 Barron
2015/0251827 A1 9/2015 Campbell
2019/0071224 A1 3/2019 Berge
2022/0315302 A1 * 10/2022 Minnette ..... B65D 47/0842

FOREIGN PATENT DOCUMENTS

CN 101848841 A 9/2010
CN 102089220 A 6/2011
EP 2308772 A1 4/2011
EP 2371733 A1 10/2011
EP 3135600 A1 3/2017
EP 3880574 A1 9/2021
EP 3947180 A1 2/2022
ES 2214652 T3 9/2004
JP 2011173632 A 9/2011
KR 20090005746 A 1/2009

* cited by examiner

TETHERED CAP AND SPOUT

CROSS-REFERENCE TO RELATED APPLICATION(S)

This application is a national stage entry of International Patent Application Serial No. PCT/US2020/036945, filed Jun. 10, 2020, which claims priority to Spanish Application Serial No. P201930525, filed Jun. 10, 2019, the entire disclosures of which are incorporated herein.

TECHNICAL FIELD

This disclosure relates to packaging and in particular, tethered caps and spouts for containers.

BACKGROUND

Containers, such as bottles, use caps to seal and contain a material in the container. Removal of the cap allows access to the material. However, the cap may be mislaid or lost, and re-closing of the container is then not possible.

SUMMARY

Disclosed herein are tethered cap and spout combinations. The tethered cap and spout combinations prevent loss of the cap after opening. In an implementation, the tethered cap and spout combinations may provide mechanisms for puncturing or opening a seal that may be present at a throat or neck of the container which provides both an anti-tampering and freshness function. In an implementation, the tethered cap and spout combinations may provide anti-tampering mechanisms. In an implementation, the tethered cap and spout combinations may provide mechanisms to hold an opened and tethered cap away from the container opening during use.

In an implementation, the tethered cap and spout includes a base and a sidewall. A spout is configured to engage the cap and a retaining element is secured with respect the spout. A tab is connected to the sidewall and a pair of non-linear flexible members connected to at least the retaining element. A rotation of the cap causes the pair of non-linear flexible members to rise and the tab to engage with a neck of the spout in a stay-back position.

In an implementation, the tethered cap and spout includes a cutting mechanism configured to be in engagement with at least a camming mechanism included in the cap, where the camming mechanism engages the cutting mechanism to push through a seal.

In an implementation, the pair of non-linear flexible members are connected to the tab, the tab is a radial tab extending from a junction including the pair of flexible members and the sidewall, the pair of flexible members converge and are connected at a same point to the retaining element, and the pair of flexible members are in a serpentine-type configuration.

In an implementation, the pair of flexible members are connected to the tab, the tab is a downward tab from the sidewall, each flexible member is connected to a different portion of the retaining element, and the pair of flexible members are in a circumferential arc configuration.

In an implementation, the pair of flexible members are connected to a different portion of the sidewall, the pair of flexible members are connected to a different portion of the retaining element, and the pair of flexible members are in a L-shaped configuration.

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
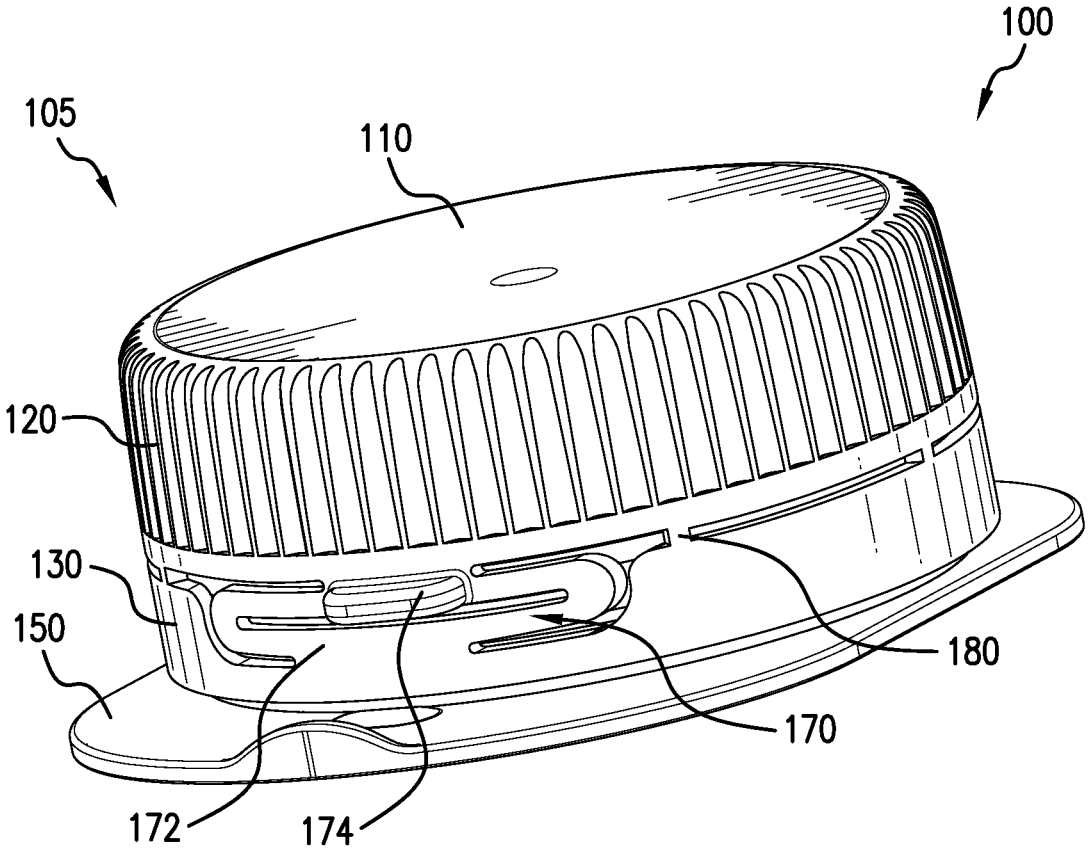
FIG. 1 is a diagram of a tethered cap and spout combination in a closed position in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to tethered cap and spout combinations. The tethered cap and spout combinations and methods for making the tethered cap and spout combinations may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the device and the methods for making the devices.

Disclosed herein are implementations of tethered cap and spout combinations. The implementations shown are illustrative and other implementations may include grips or protrusions for aiding in opening the cap which are within the scope of the specification and claims described herein.

FIG. 1 is a view of a tethered cap and spout combination 100 in a closed position in accordance with certain implementations. The tethered cap and spout combination 100 includes a cap 105, a retaining element 130, a retaining element lock mechanism 140 (shown in FIG. 4), and a spout 150. The cap 105 includes a base 110 and a sidewall 120. The sidewall 120 and the retaining element 130 includes or operates with (collectively "includes") a tether mechanism 170 which is attached via a plurality of rupture members 180. The tether mechanism 170 includes a tethered hinge 172 and a radial tab 174 which performs as a lock or cap stay-back mechanism. The tethered hinge 172 includes a pair of circumferential arc or serpentine type flexible member 176 and 178 which are connected to the retaining element 130 at one end and to the sidewall 120 at another end. The radial tab 174 extends from the juncture of the flexible members 176 and 178 and the sidewall 120. In an implementation, the retaining element 130 and the plurality of rupture members 180 may function as an anti-tampering device.

Figure 2:
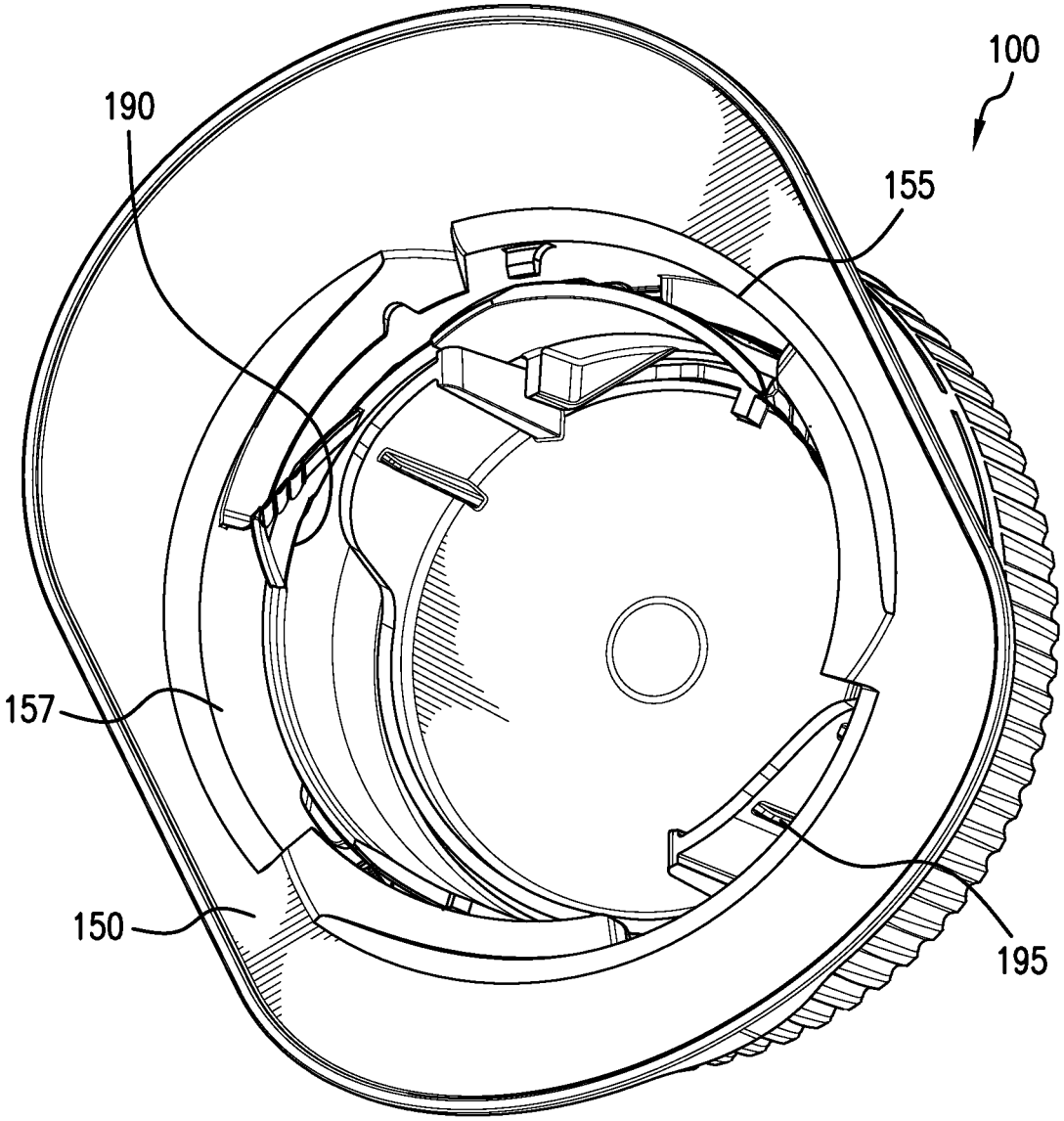
FIG. 2 is a bottom view of the tethered cap and spout combination of FIG. 1 in accordance with certain implementations.

FIG. 2 is a bottom view of the tethered cap and spout combination 100 of FIG. 1 in a closed position in accordance with certain implementations. In addition to the elements shown in FIG. 1, and not repeated here for clarity, the tethered cap and spout combination 100 further includes a cutter mechanism 190 which is engaged with protrusions 155 on an internal wall 157 of the spout 150 and a camming mechanism 195 disposed internally with respect to the base 110 and the sidewall 120. In an implementation, the tethered cap and spout combination 100 may not include the cutter mechanism 190.

Figure 3:
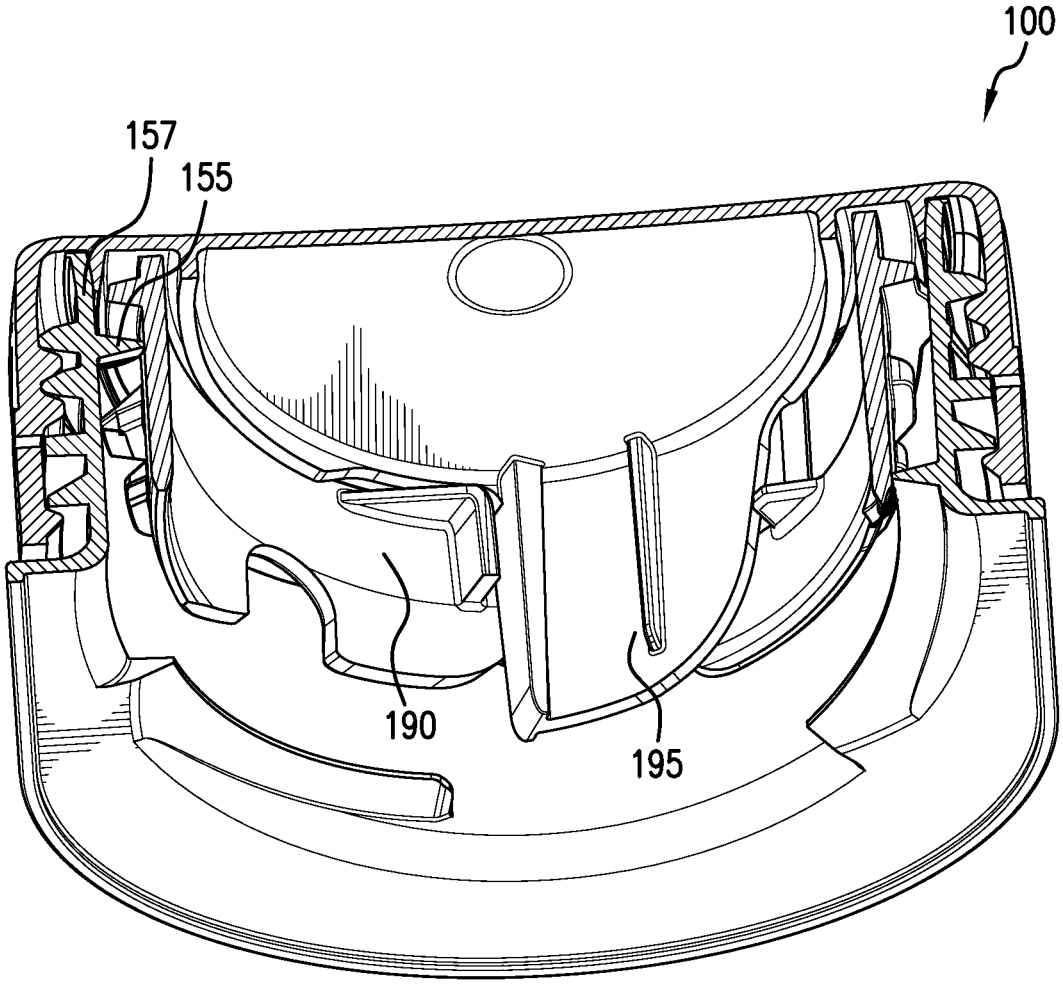
FIG. 3 is a cross-sectional bottom view of the tethered cap and spout combination of FIG. 1 in accordance with certain implementations.

FIG. 3 is a cross-sectional view of the tethered cap and spout combination 100 of FIG. 1 in a closed position in accordance with certain implementations and shows the elements described herein with respect to FIGS. 1-2. In particular, the cutter mechanism 190 is engaged with the protrusions 155 on the internal wall 157 of the spout 150 and the camming mechanism 195.

Figure 4:
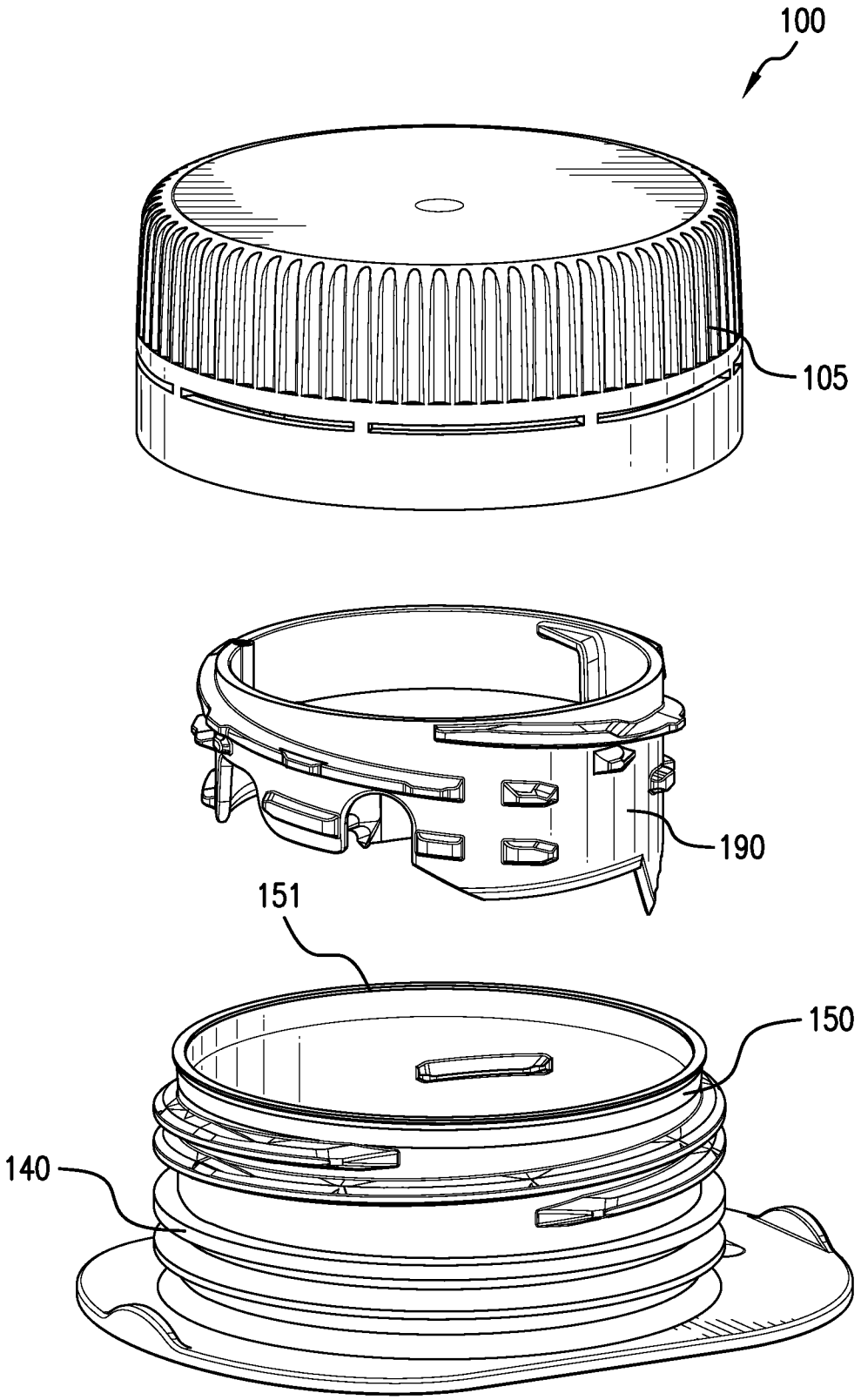
FIG. 4 is an exploded view of the tethered cap and spout combination of FIG. 1 in accordance with certain implementations.

FIG. 4 is an exploded view of the tethered cap and spout combination of FIG. 1 in a closed position in accordance with certain implementations and shows the elements described herein with respect to FIGS. 1-3. In particular, FIG. 4 shows the cap 105, the cutter mechanism 190, the spout 150, and a mouth 151 of the spout 150.

Figure 5A:
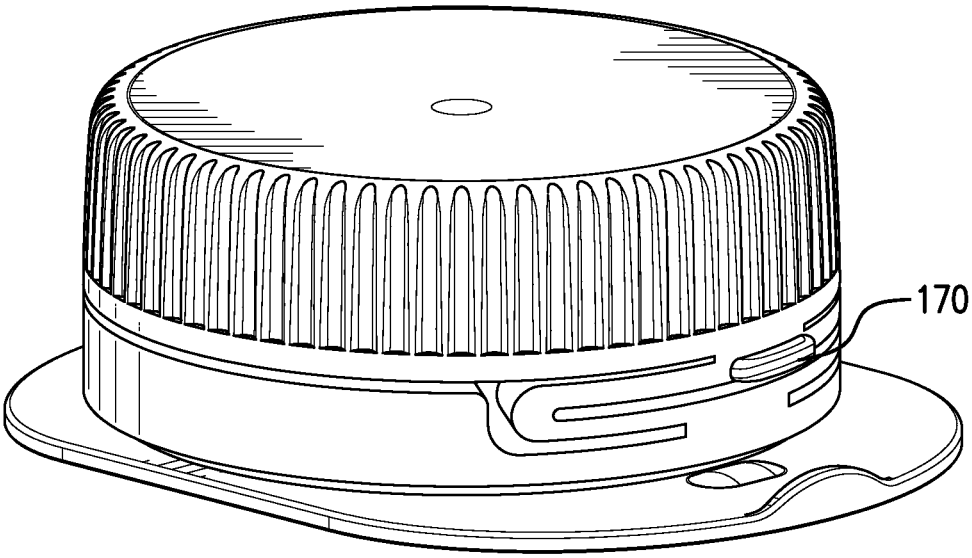
FIGS. 5A and 5B are other views of the tethered cap and spout combination of FIG. 1 in accordance with certain implementations.
Figure 5B:
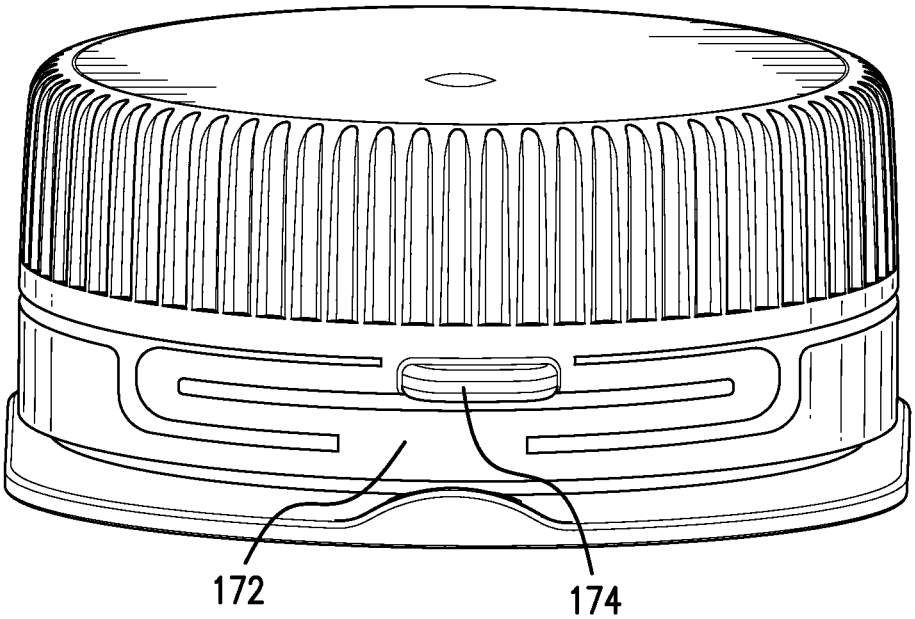
Figure 6:
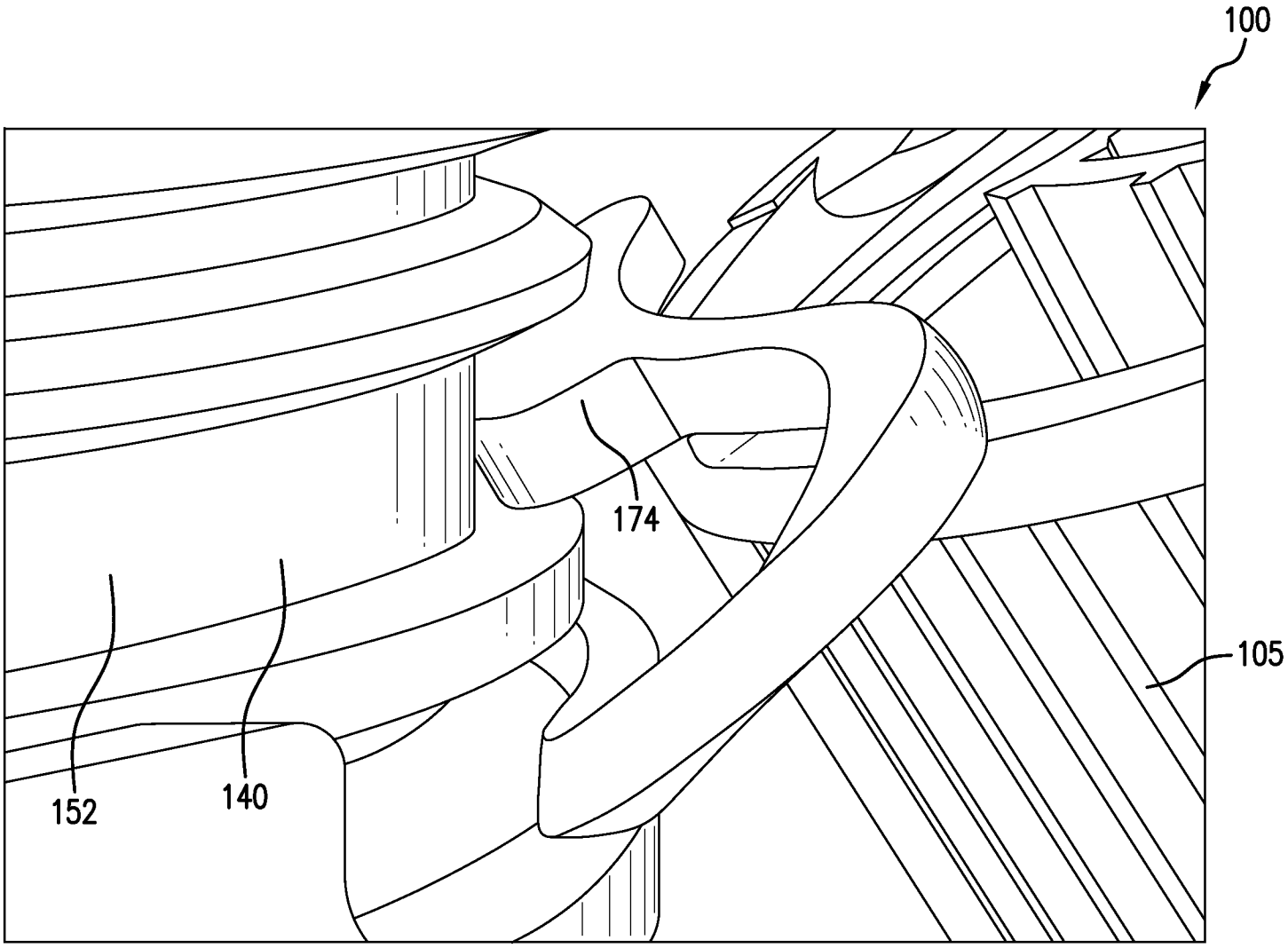
FIG. 6 is a view of the locking mechanism of the tethered cap and spout combination of FIG. 1 in accordance with certain implementations.
Figure 7A:
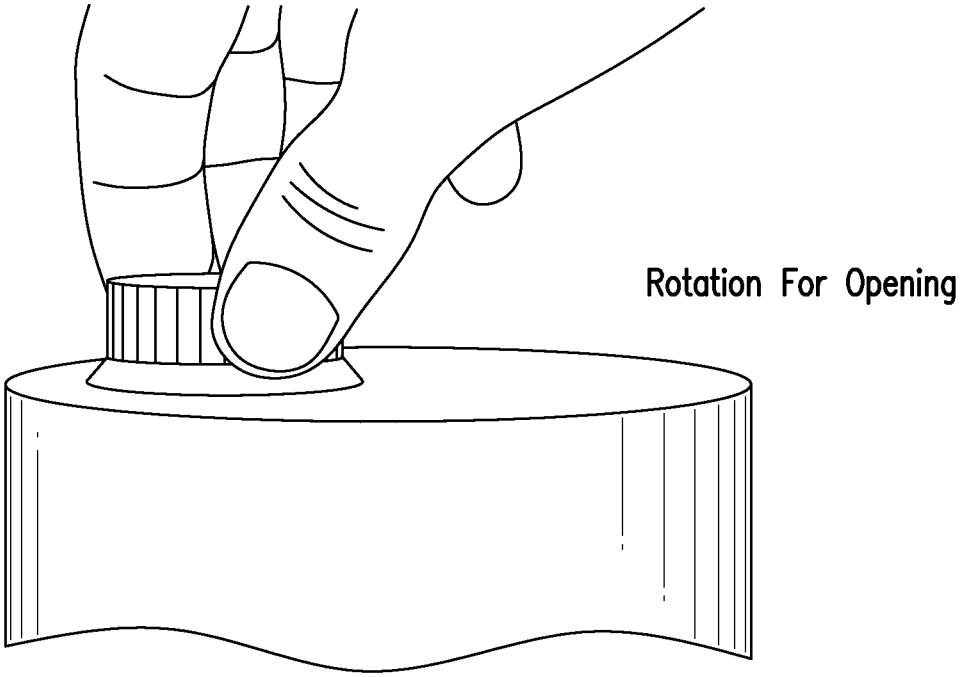
FIGS. 7A-7D are a view of the tethered cap and spout combination of FIG. 1 cycling through closed-open-closed in accordance with implementations.
Figure 7B:
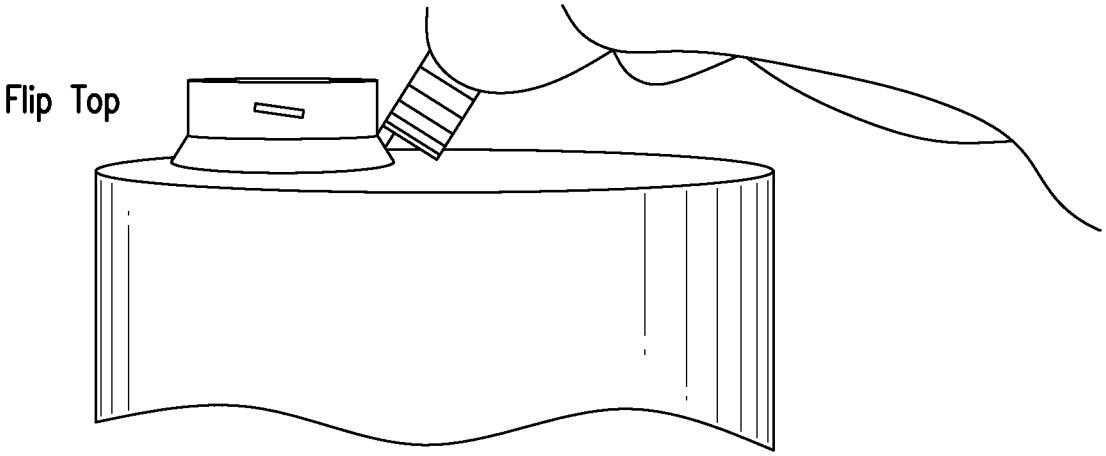
Figure 7C:
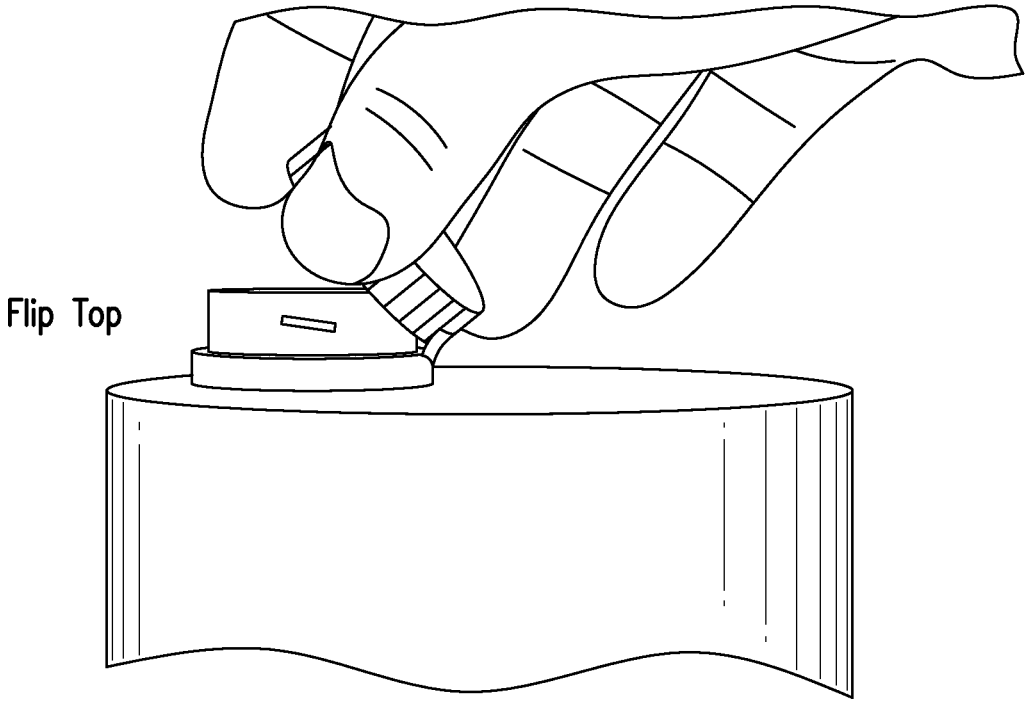
Figure 7D:
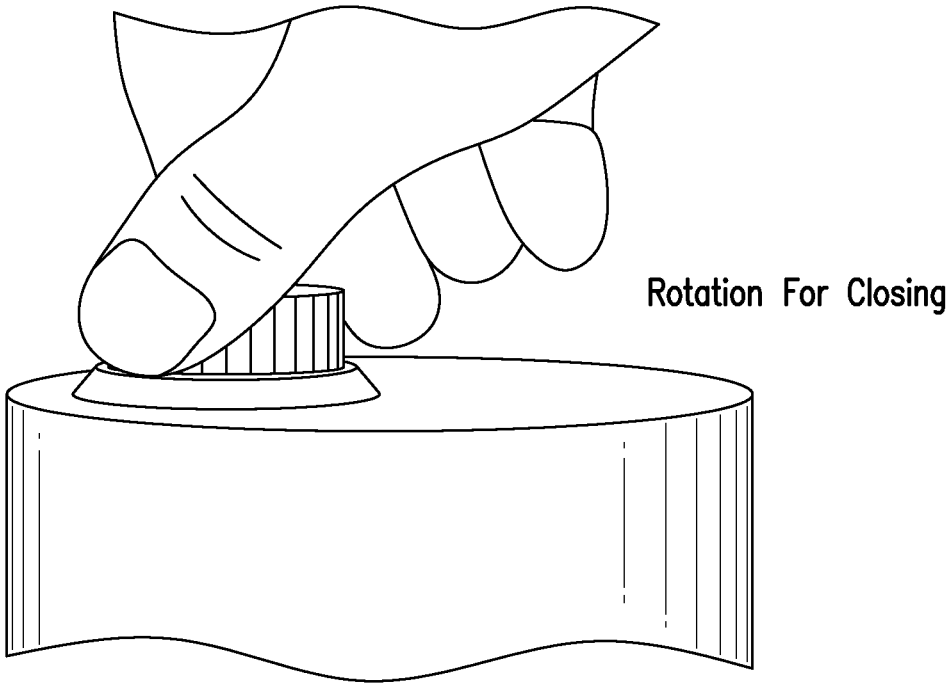

FIGS. 5A and 5B are other views of the tethered cap and spout combination 100 of FIG. 1 in accordance with certain implementations. In particular, FIG. 5A shows the tether mechanism 170 and FIG. 5B shows the tethered hinge 172 and the radial tab 174, which is shown in an engaged position in FIG. 6. In particular, FIG. 6 is a view of the locking mechanism of the tethered cap and spout combination 100 of FIG. 1 in accordance with certain implementations. In an opened position, the radial tab 174 engages a portion of a neck 152 of the spout 150 to keep the cap 105 in a stay-back position with respect to the mouth 151 (as shown in FIG. 4) of the spout 150. In an implementation, the radial tab 174 may engage a section of the retaining element lock mechanism 140. In an implementation, the radial tab 174 may engage threads 159 of the spout 150.

FIGS. 7A-7D are a view of the tethered cap and spout combination 100 of FIG. 1 cycling through closed-open-closed in accordance with implementations. Operationally, the cap 105 is sufficiently rotated (for example, maybe 180°-360° and the like) to rupture the plurality of rupture members 180. The tethered hinge 172 rises and stretches from a flat closed position. Nearly simultaneously, when the tethered cap and spout combination 100 includes the cutting mechanism 190, the camming mechanism 195 engages the cutting mechanism 190, which may then puncture a seal on a container (where the tethered cap and spout combination 100 is implemented on the container). The cap 105 is then flipped up and kept away from the mouth 151 of the spout 150 by the length of the tethered hinge 172 and by having the radial tab 174 engage a portion of the neck 152 of the spout 150. To close, the cap 105 is flipped back on and screwed onto the spout 150.

Figure 8:
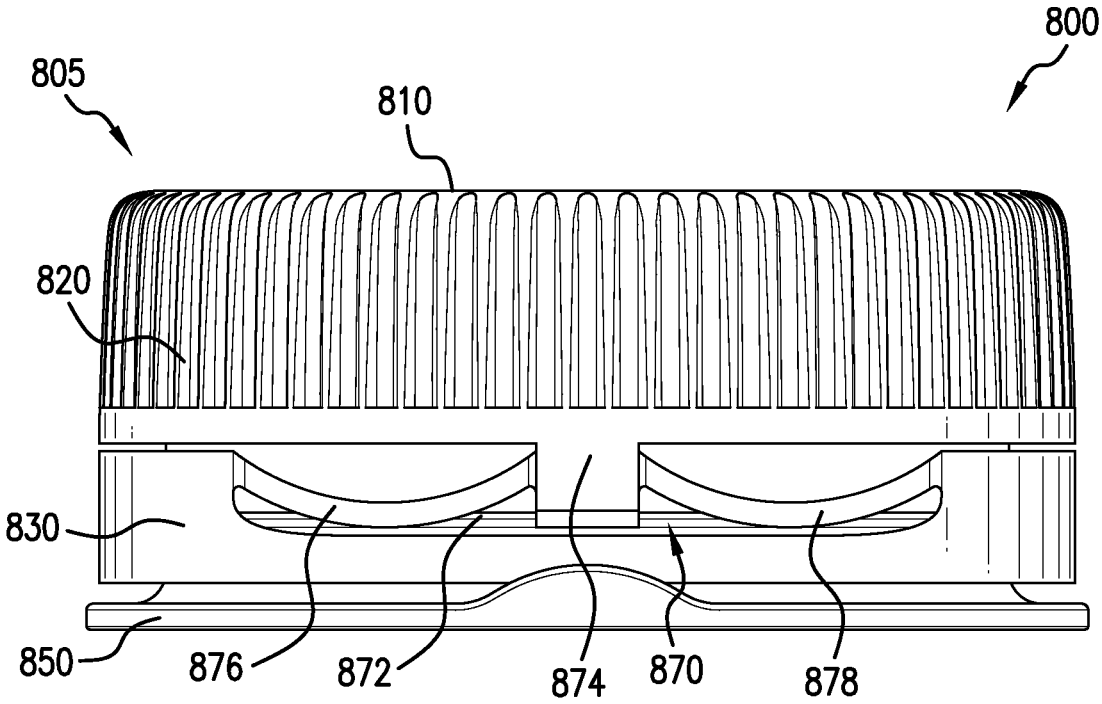
FIG. 8 is a view of another tethered cap and spout combination in a closed position in accordance with certain implementations.

FIG. 8 is a view of a tethered cap and spout combination 800 in a closed position in accordance with certain implementations. The tethered cap and spout combination 800 includes a cap 805, a retaining element 830, a retaining element lock mechanism 840 (shown in FIG. 10), and a spout 850. The cap 805 includes a base 810 and a sidewall 820. The sidewall 820 and the retaining element 830 includes a tether mechanism 870. The tether mechanism 870 includes a tethered hinge 872 and a downward tab 874 which functions as a lock or cap stay-back mechanism. The tethered hinge 872 includes a pair of circumferential arc flexible members 876 and 878, which are connected to the retaining element 830 at one end and to the downward tab 874 at another end. The downward tab 874 is further connected to the sidewall 820. In an implementation, the retaining element 130 may function as an anti-tampering device.

Figure 9:
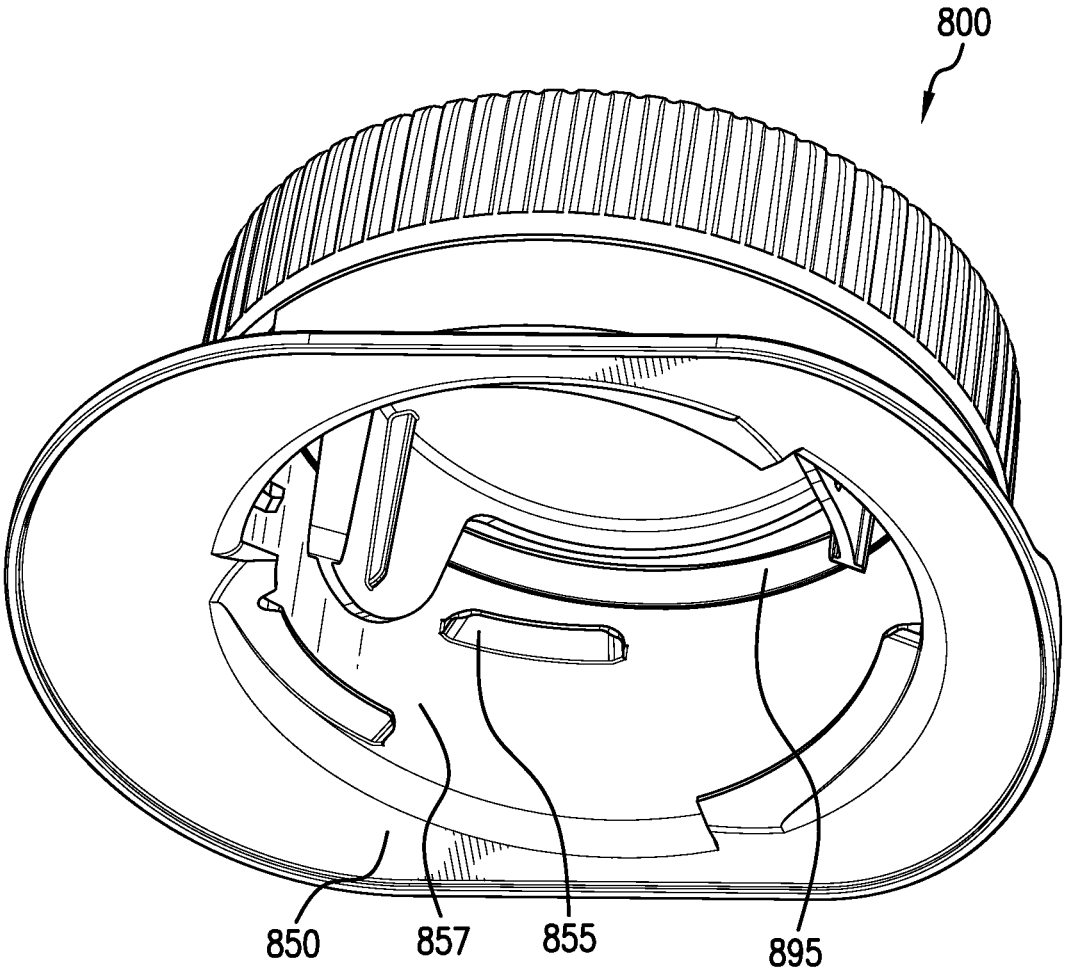
FIG. 9 is a bottom view of the tethered cap and spout combination of FIG. 8 in a closed position in accordance with certain implementations.

FIG. 9 is a bottom view of the tethered cap and spout combination 800 of FIG. 8 in a closed position in accordance with certain implementations. In addition to the elements shown in FIG. 8, and not repeated here for clarity, the tethered cap and spout combination 800 further includes protrusions 855 on an internal wall 857 of the spout 850 which may engage a camming mechanism 895 disposed internally with respect to the base 810 and the sidewall 820. In an implementation, the tethered cap and spout combination 800 may include a cutter mechanism which would operate as described with respect to FIG. 1.

Figure 10:
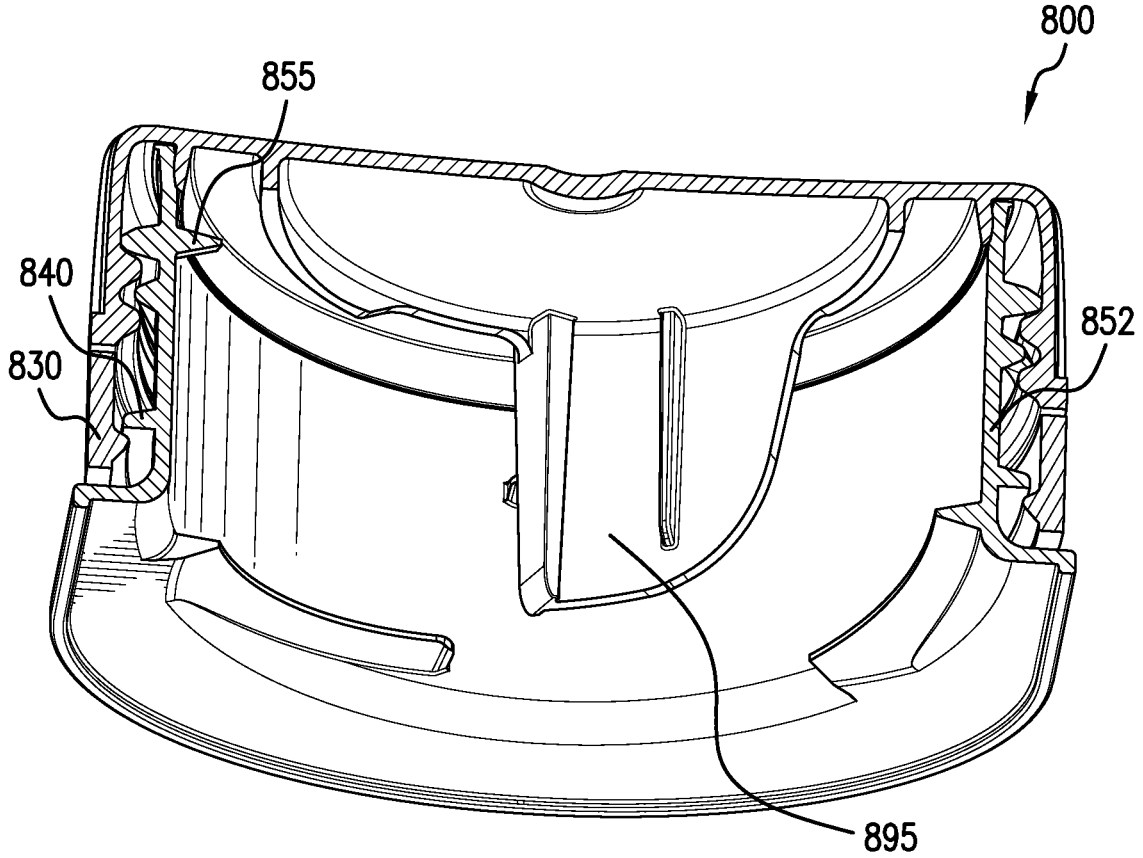
FIG. 10 is a cross-sectional bottom view of the tethered cap and spout combination of FIG. 8 in a closed position in accordance with certain implementations.

FIG. 10 is a cross-sectional view of the tethered cap and spout combination 800 of FIG. 8 in a closed position in accordance with certain implementations and shows the elements described herein with respect to FIGS. 8-9. In particular, a neck 852 of the spout 850 is shown. In addition, the protrusions 855 may be configured to engage with the camming mechanism 895. Also shown is the retaining element lock mechanism 840 which is configured to engage the retaining element 830.

Operationally, the cap 805 is sufficiently rotated (for example, maybe 180°-360° and the like) which causes the tethered hinge 872 to rise and stretch from a flat closed position. The cap 805 is then flipped up and kept away from a mouth of the spout 850 by the length of the tethered hinge 872 and by having the downward tab 874 engage a portion of the neck 852 of the spout 850. To close, the cap 805 is flipped back on and screwed onto the spout 850.

Figure 11:
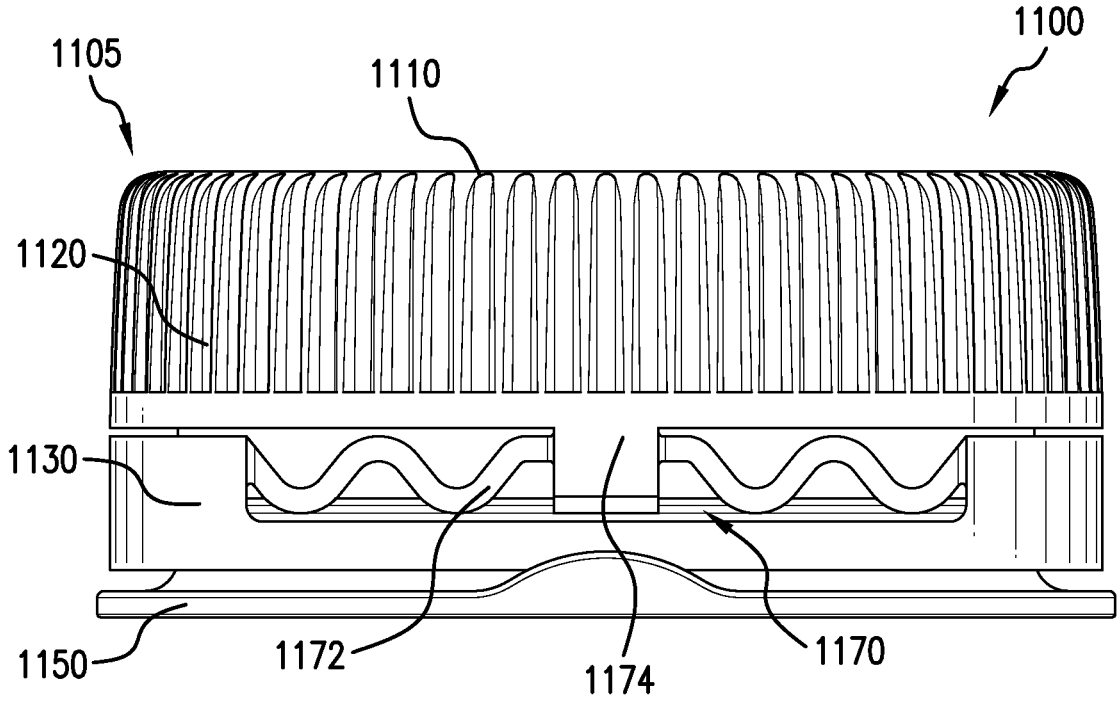
FIG. 11 is a view of another tethered cap and spout combination in a closed position in accordance with certain implementations.

FIG. 11 is a view of a tethered cap and spout combination 1100 in a closed position in accordance with certain implementations. The tethered cap and spout combination 1100 includes a cap 1105, a retaining element 1130, a retaining element lock mechanism 1140 (shown in FIGS. 14 and 15), and a spout 1150. The cap 1105 includes a base 1110 and a sidewall 1120. The sidewall 1120 and the retaining element 1130 includes a tether mechanism 1170. The tether mechanism 1170 includes a tethered hinge 1172 and a downward tab 1174 which functions as a lock or cap stay-back mechanism. In an implementation, the retaining element 1130 may function as an anti-tampering device.

Figure 12:
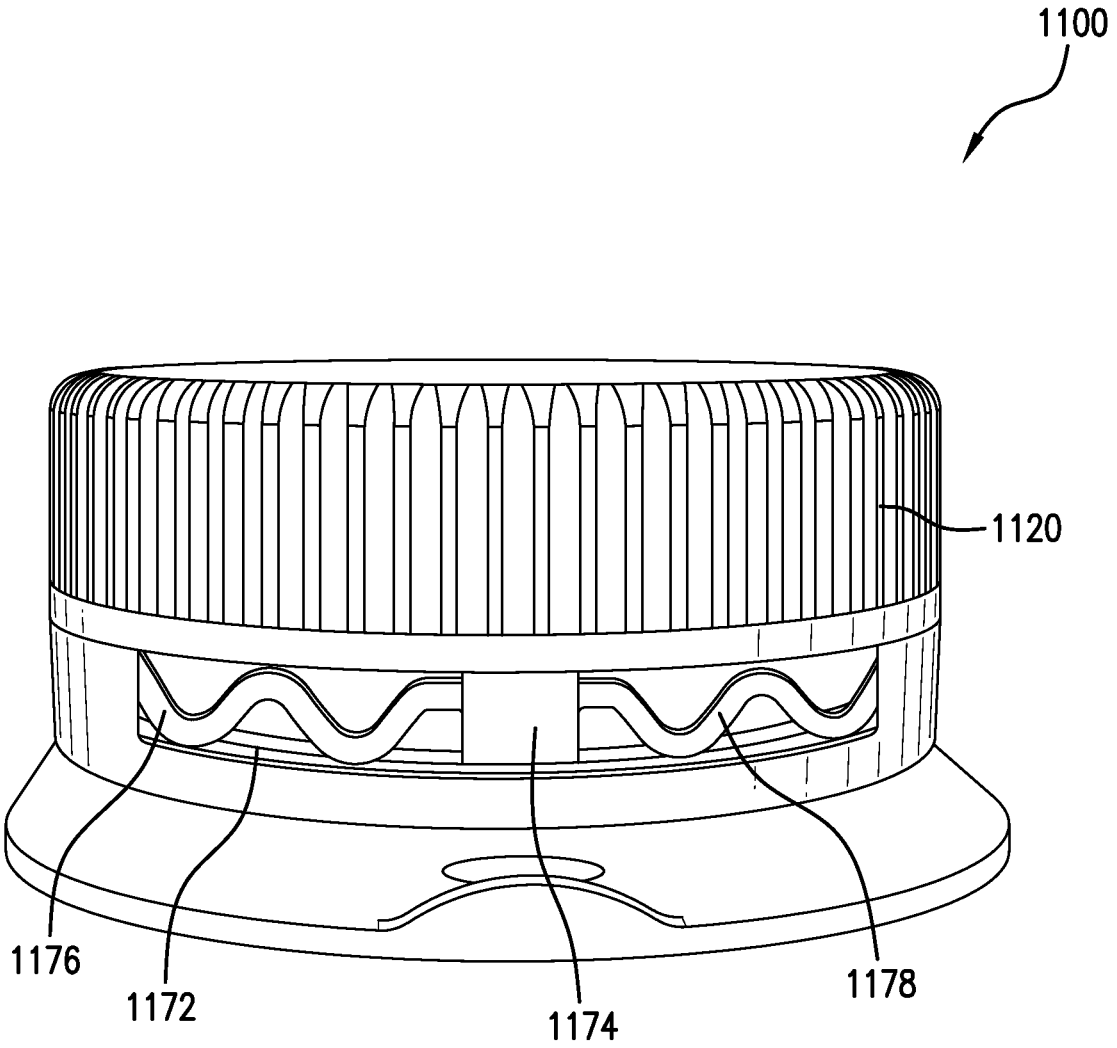
FIG. 12 is another view of the tethered cap and spout combination of FIG. 11 in a closed position in accordance with certain implementations.

FIG. 12 is another view of the tethered cap and spout combination 1100 of FIG. 11 in a closed position in accordance with certain implementations showing the tethered hinge 1172 and the downward tab 1174. In particular, the tethered hinge 1172 includes a pair of circumferential arc or serpentine type flexible members 1176 and 1178, which are connected to the retaining element 1130 at one end and to the downward tab 1174 at another end. The downward tab 1174 is further connected to the sidewall 1120.

Figure 13:
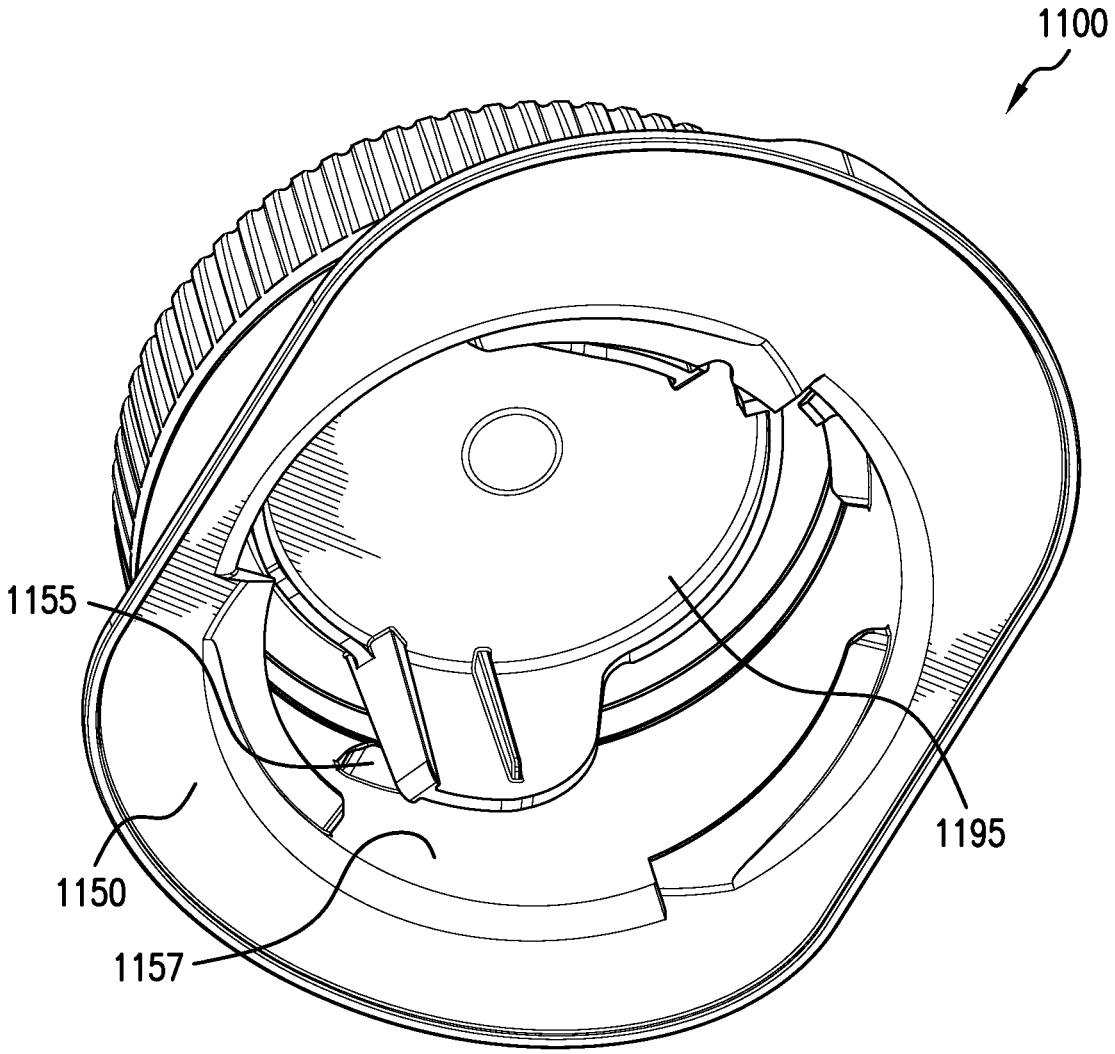
FIG. 13 is a bottom view of the tethered cap and spout combination of FIG. 11 in a closed position in accordance with certain implementations.

FIG. 13 is a bottom view of the tethered cap and spout combination 1100 of FIG. 11 in a closed position in accordance with certain implementations. In addition to the elements shown in FIG. 11, and not repeated here for clarity, the tethered cap and spout combination 1100 further includes protrusions 1155 on an internal wall 1157 of the spout 1150 which may engage with a camming mechanism 1195 disposed internally with respect to the base 1110 and the sidewall 1120. In an implementation, the tethered cap and spout combination 1100 may include a cutter mechanism (as shown in FIG. 15) which would operate as described with respect to FIG. 1.

Figure 14:
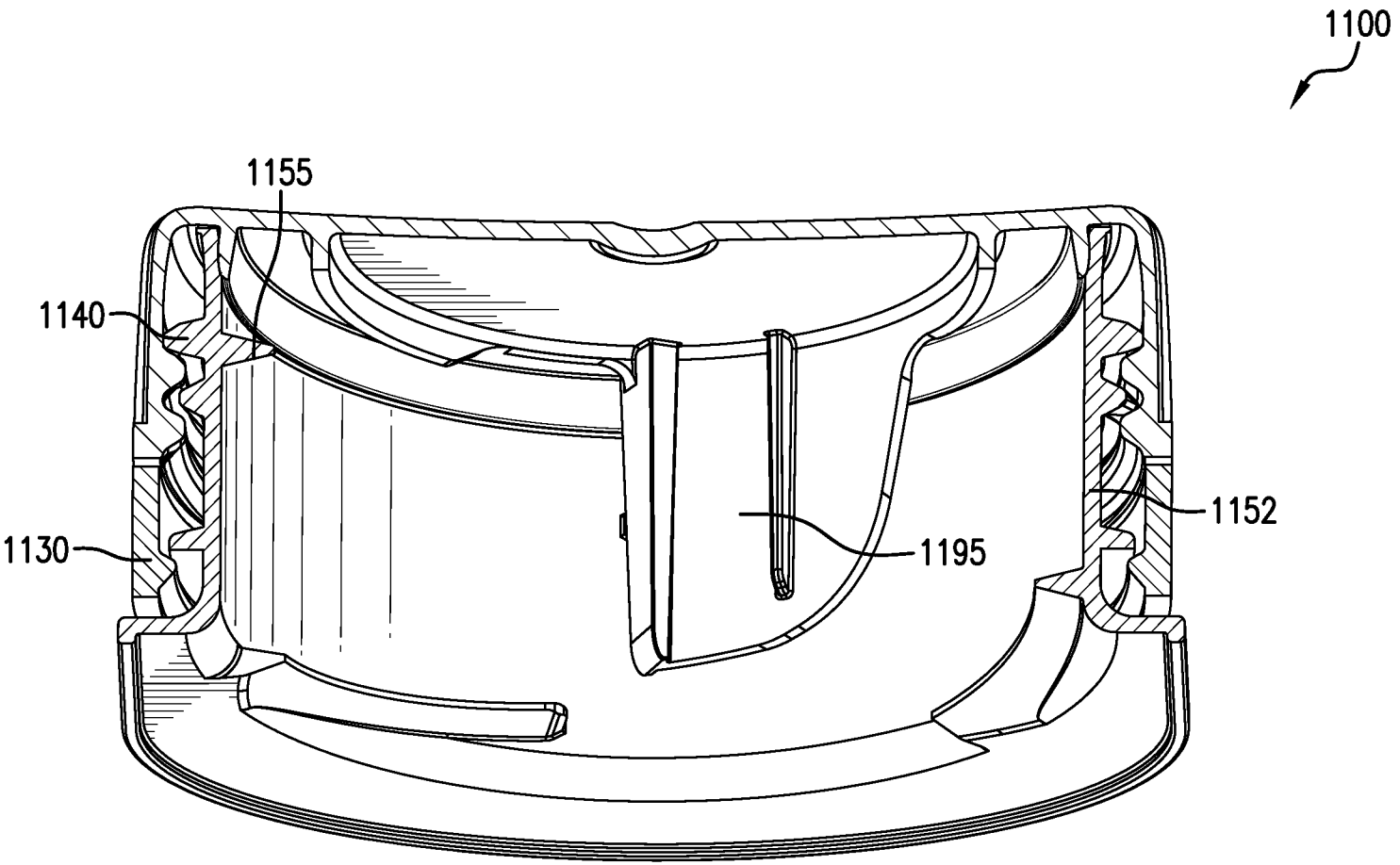
FIG. 14 is a cross-sectional bottom view of the tethered cap and spout combination of FIG. 11 in a closed position in accordance with certain implementations.

FIG. 14 is a cross-sectional view of the tethered cap and spout combination 1100 of FIG. 8 in a closed position in accordance with certain implementations and shows the elements described herein with respect to FIGS. 11-13. In particular, a neck 1152 of the spout 1150 is shown. In addition, the protrusions 1155 may be configured to engage with the camming mechanism 1195. Also shown is the retaining element lock mechanism 1140 which is configured to engage the retaining element 1130.

Figure 15:
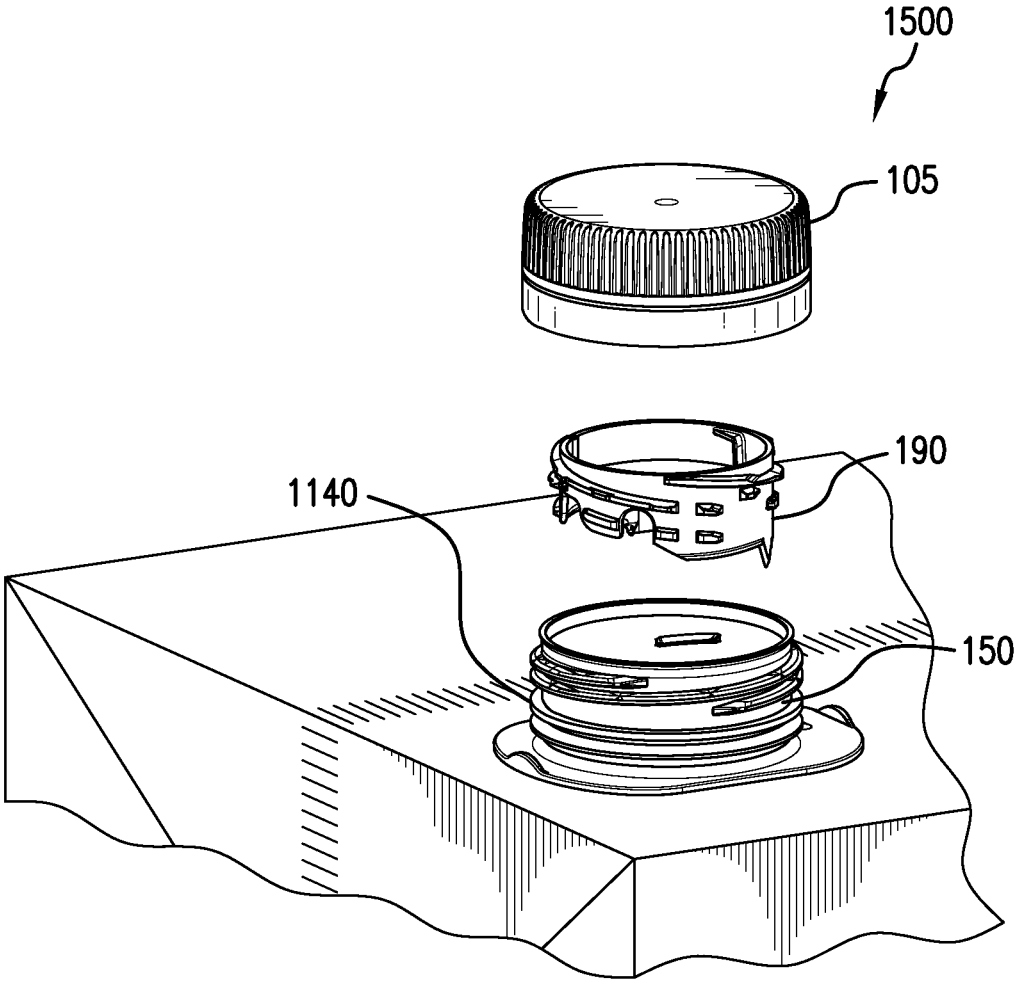
FIG. 15 is an exploded view of the tethered cap and spout combination of FIG. 13 in accordance with certain implementations.

FIG. 15 is an exploded view of a tethered cap and spout combination in accordance with certain implementations. The tethered cap and spout combination 1500 may include a cap 1505, a cutter mechanism 1590, a spout 1550, and a mouth 1551 of the spout 1550. Functionally and operationally the tethered cap and spout combination 1500 may work as described for the tethered cap and spout combination 1100 with the inclusion of the cutter mechanism 1590, which operates as described with respect to the tethered cap and spout combination 100.

Operationally, the cap 1105 is sufficiently rotated (for example, maybe 180°-360° and the like) which causes the tethered hinge 1172 to rise and stretch from a flat closed position. The cap 1105 is then flipped up and kept away from a mouth of the spout 1150 by the length of the tethered hinge 1172 and by having the downward tab 1174 engage a portion of the neck 1152 of the spout 1150. To close, the cap 1105 is flipped back on and screwed onto the spout 1150.

Figure 16:
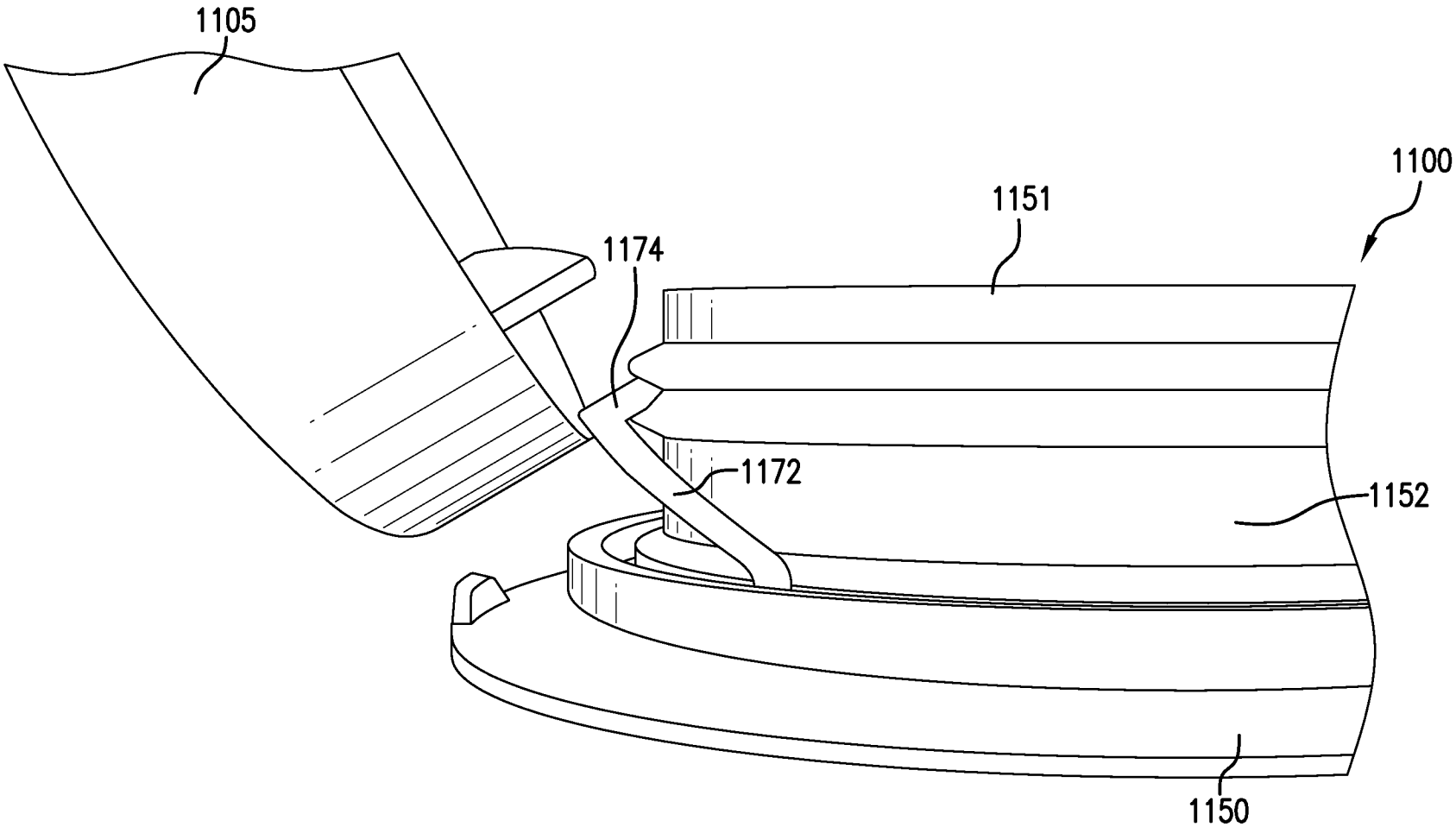
FIG. 16 is an image of an opened tethered cap and spout combination of FIG. 13 in accordance with certain implementations.

FIG. 16 is an image of the tethered cap and spout combination 1100 of FIG. 13 in an open position in accordance with certain implementations. As shown, the cap 1105 is flipped back, the tethered hinge 1172 is stretched up, and the downward tab 1174 is engaged with the neck 1152 of the spout 1150 to keep the cap 1105 away from a mouth 1151 of the spout 1150.

Figure 17:
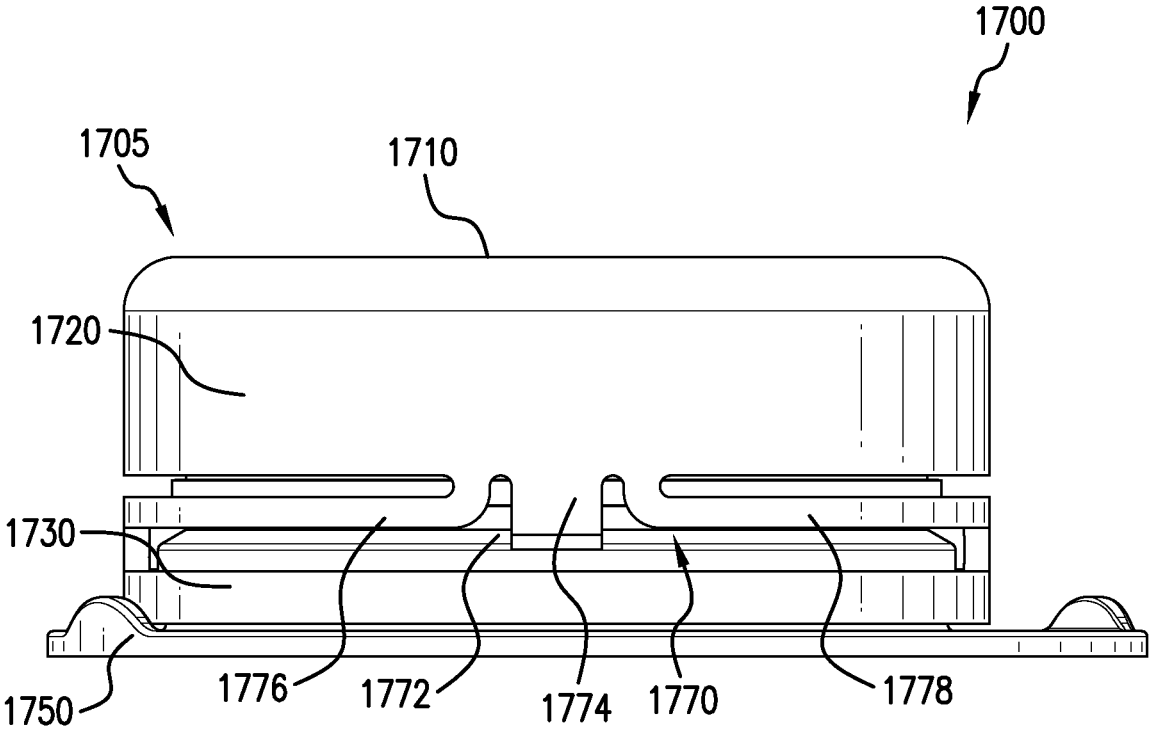
FIG. 17 is a view of another tethered cap and spout combination in a closed position in accordance with certain implementations.

FIG. 17 is a view of a tethered cap and spout combination 1700 in a closed position in accordance with certain implementations. The tethered cap and spout combination 1700 includes a cap 1705, a retaining element 1730, a retaining element lock mechanism 1740 (shown in FIG. 19), and a spout 1750. The cap 1705 includes a base 1710 and a sidewall 1720. The sidewall 1720 and the retaining element 1730 includes a tether mechanism 1770. The tether mechanism 1770 includes a tethered hinge 1772 and a downward tab 1774 which functions as a lock or cap stay-back mechanism. The tethered hinge 1772 includes a pair of L-shaped flexible members 1776 and 1778, which are connected to the retaining element 1730 at one end and to the sidewall 1720 at another end. The downward tab 1774 is connected to the sidewall 1720. In an implementation, the retaining element 1730 may function as an anti-tampering device.

Figure 18:
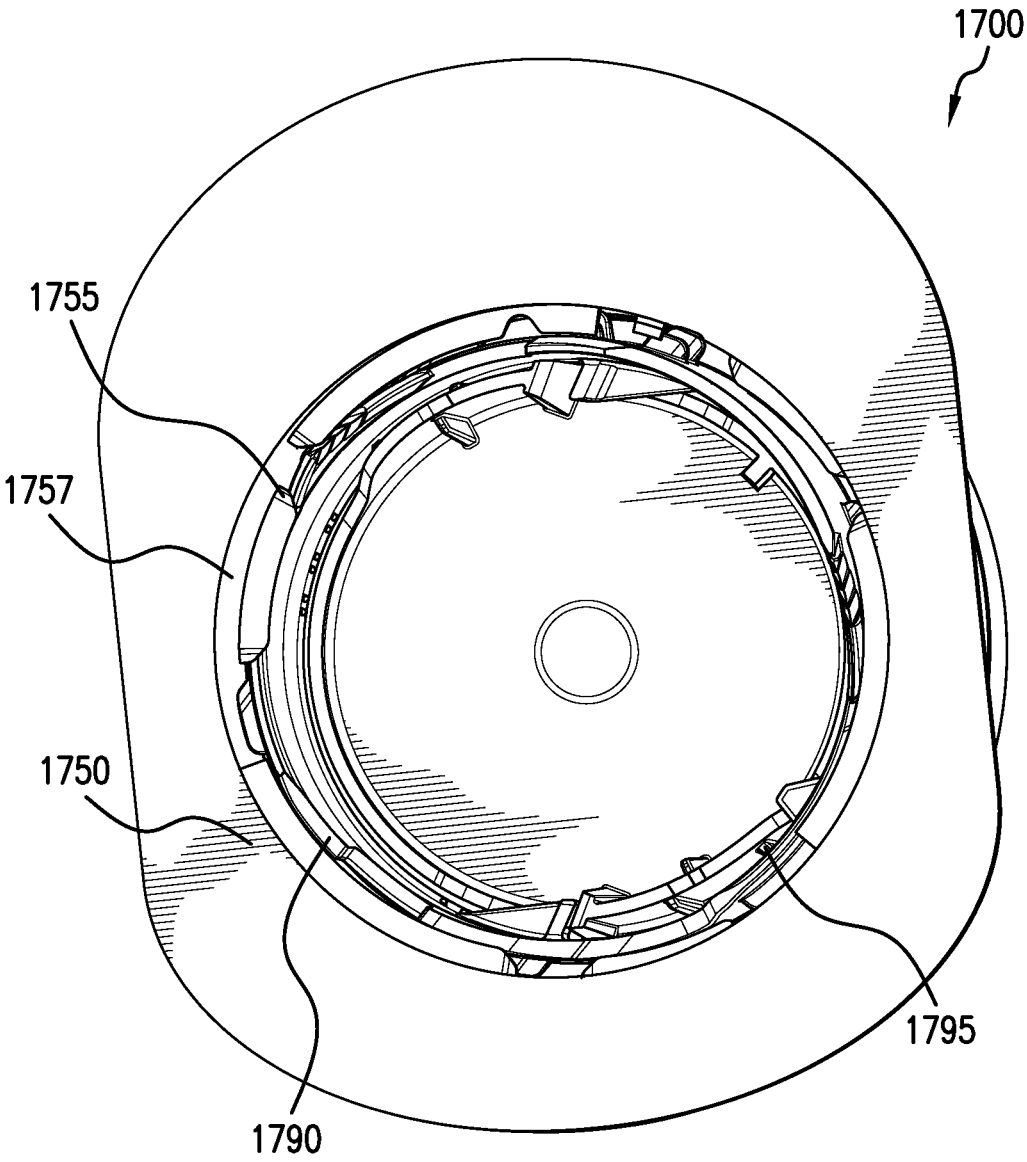
FIG. 18 is a bottom view of the tethered cap and spout combination of FIG. 17 in a closed position in accordance with certain implementations.

FIG. 18 is a bottom view of the tethered cap and spout combination 1700 of FIG. 1 in a closed position in accordance with certain implementations. In addition to the elements shown in FIG. 1, and not repeated here for clarity, the tethered cap and spout combination 1700 further includes a cutter mechanism 1790 which is configured to engage with protrusions 1755 on an internal wall 1757 of the spout 1750 and a camming mechanism 1795 disposed internally with respect to the base 1710 and the sidewall 1720. In an implementation, the tethered cap and spout combination 100 may not include the cutter mechanism 1790.

Figure 19:
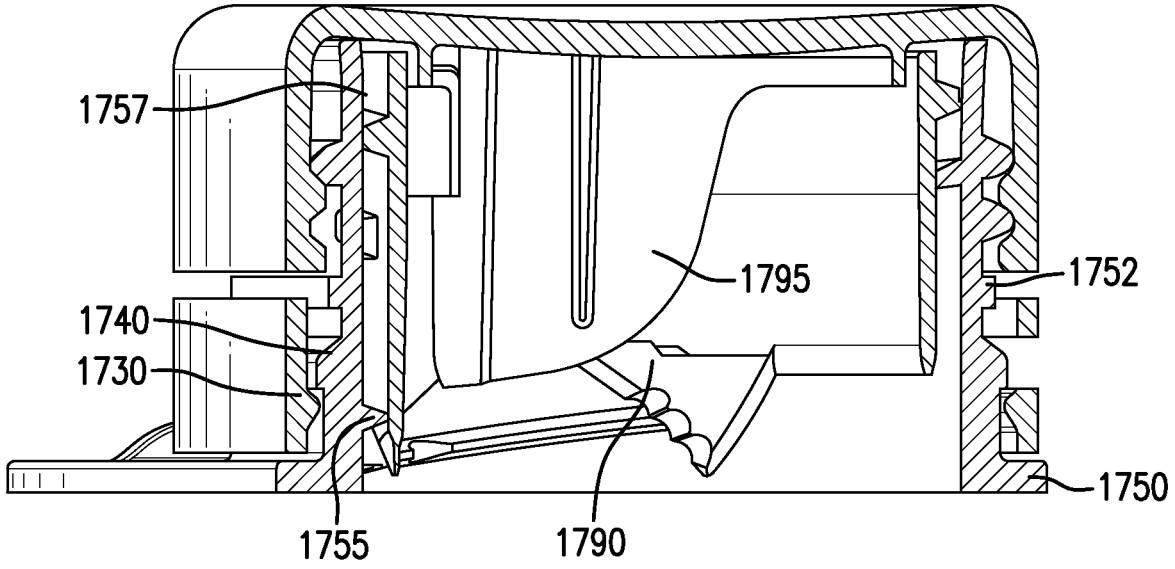
FIG. 19 is a cross-sectional view of the tethered cap and spout combination of FIG. 17 in a closed position in accordance with certain implementations.

FIG. 19 is a cross-sectional view of the tethered cap and spout combination 1700 of FIG. 17 in a closed position in accordance with certain implementations and shows the elements described herein with respect to FIGS. 17-18. In particular, a neck 1752 of the spout 1750 is shown. The cutter mechanism 1790 may be engaged with the protrusions 1755 on the internal wall 1757 of the spout 1750 and the camming mechanism 1795. Also shown is the retaining element lock mechanism 1740 which is configured to engage the retaining element 1730.

Operationally, the cap 1705 is sufficiently rotated (for example, maybe 180°-360° and the like) which causes the tethered hinge 1772 to rise and stretch from a flat closed position. Nearly simultaneously, when the tethered cap and spout combination 1700 includes the cutting mechanism 1790, the camming mechanism 1795 engages the cutting mechanism 1790, which may then puncture a seal on a container (where the tethered cap and spout combination 1700 is implemented on the container). The cap 1705 is flipped up and kept away from a mouth of the spout 1750 by the length of the tethered hinge 1772 and by having the downward tab 1774 engage a portion of the neck 1752 of the spout 1750. To close, the cap 1705 is flipped back on and screwed onto the spout 1750.

Figure 20:
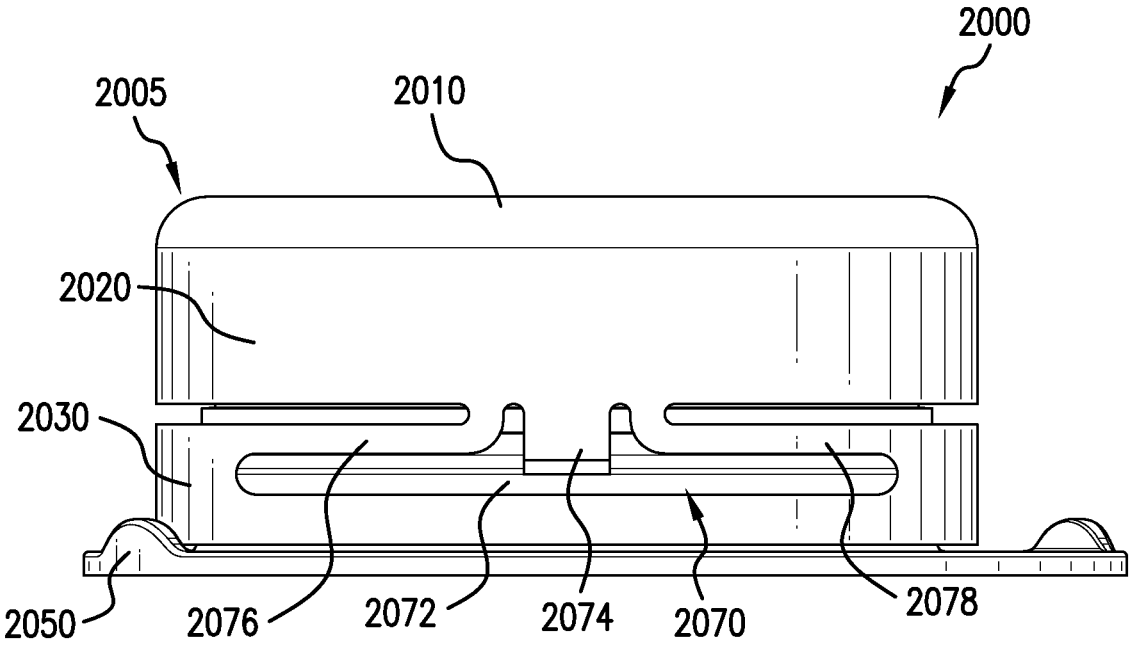
FIG. 20 is a view of another tethered cap and spout combination in a closed position in accordance with certain implementations.

FIG. 20 is a view of a tethered cap and spout combination 2000 in a closed position in accordance with certain implementations. The tethered cap and spout combination 2000 includes a cap 2005, a retaining element 2030, a retaining element lock mechanism (not shown), and a spout 2050. The cap 2005 includes a base 2010 and a sidewall 2020. The sidewall 2020 and the retaining element 2030 includes a tether mechanism 2070. The tether mechanism 2070 includes a tethered hinge 2072 and a downward tab 2074 which functions as a lock or cap stay-back mechanism. The tethered hinge 2072 includes a pair of L-shaped flexible members 2076 and 2078, which are connected to the retaining element 2030 at one end and to the sidewall 2020 at another end. The downward tab 2074 is connected to the sidewall 2020. In an implementation, the retaining element 2030 may function as an anti-tampering device. The tethered cap and spout combination 2000 is operationally and functionally similar to the tethered cap and spout combination 1700 except that the length of the circumferential arc flexible members 2076 and 2078 are longer than the circumferential arc flexible members 1776 and 1778. This may provide a greater degree of freedom and operation with respect to keeping the cap 2005 away from the mouth of the spout 2050.

Figure 21:
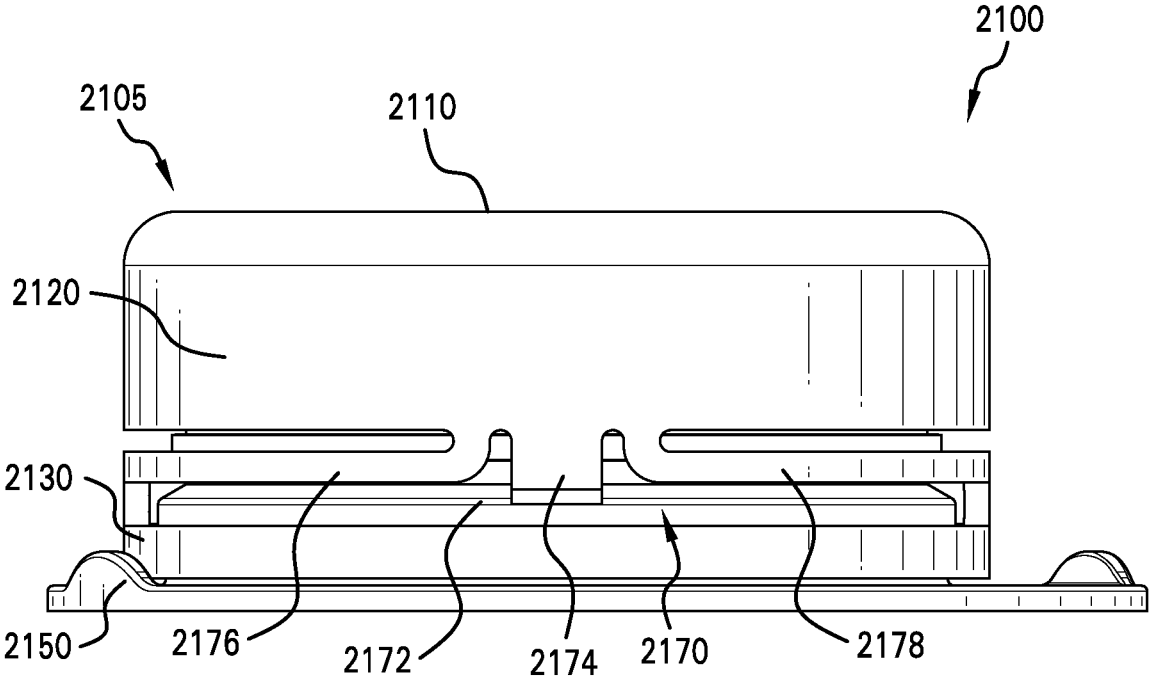
FIG. 21 is a view of another tethered cap and spout combination in a closed position in accordance with certain implementations.

FIG. 21 is a view of a tethered cap and spout combination 2100 in a closed position in accordance with certain implementations. The tethered cap and spout combination 2100 includes a cap 2105, a retaining element 2130, a retaining element lock mechanism (not shown), and a spout 2150. The cap 2105 includes a base 2110 and a sidewall 2120. The sidewall 2120 and the retaining element 2130 includes a tether mechanism 2170. The tether mechanism 2170 includes a tethered hinge 2172 and a downward tab 2174 which functions as a lock or cap stay-back mechanism. The tethered hinge 2172 includes a pair of L-shaped flexible members 2176 and 2178, which are connected to the retaining element 2130 at one end and to the sidewall 2120 at another end. The downward tab 2174 is connected to the sidewall 2120. In an implementation, the retaining element 2130 may function as an anti-tampering device. The tethered cap and spout combination 2100 is operationally and functionally similar to the tethered cap and spout combination 1700 except that the length of the circumferential arc flexible members 2176 and 2178 are longer than the circumferential arc flexible members 1776 and 1778 and the circumferential arc flexible members 2076 and 2078. This may provide a greater degree of freedom and operation with respect to keeping the cap 2105 away from the mouth of the spout 2150.

The tethered cap and spout combinations described herein may be manufactured using compression molding, injection molding and other like production processes. The tethered cap and spout may be made from polypropylene, high-density polyethylene, polyethylene terephthalate (PET) and the like.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A device comprising:

a cap including a base, a sidewall and a camming mechanism on an internal side of the base and the sidewall;

a spout, the spout configured to engage the cap;

a cutting mechanism configured to be in engagement with at least the camming mechanism;

a retaining element secured with respect to the spout; and a tether mechanism connected to the retaining element and the sidewall of the cap, wherein at least rotation of the cap:

engages the camming mechanism with the cutting mechanism to push through a seal; and causes the tether mechanism to rise and engage with a neck of the spout in a stay-back position.

2. The device of claim 1, wherein the tether mechanism further comprising:

a tab connected to at least the sidewall, the tab configured to engage the neck when the cap is opened.

3. The device of claim 2, wherein the tether mechanism further comprising:

a pair of flexible members connected to the tab and to the retaining element, the pair of flexible members configured to rise and provide distance between a mouth of the spout and the cap when the cap is opened.

4. The device of claim 3, wherein the pair of flexible members converge and are connected at a same point to the retaining element.

5. The device of claim 4, wherein the tab is a radial extending from a junction including the pair of flexible members and the sidewall.

6. The device of claim 2, wherein the pair of flexible members are in a serpentine-type configuration.

7. The device of claim 2, wherein the tether mechanism further comprising:

a pair of flexible members connected to the tab, each flexible member connected to a different portion of the retaining element, the pair of flexible members configured to rise and provide distance between a mouth of the spout and the cap when the cap is opened.

8. The device of claim 7, wherein the pair of flexible members are in a circumferential arc configuration.

9. The device of claim 8, wherein the tab is a downward tab from the sidewall.

10. The device of claim 2, wherein the tether mechanism further comprising:

a pair of flexible members, each flexible member connected to a different portion of the sidewall and a different portion of the retaining element, the pair of flexible members configured to rise and provide distance between a mouth of the spout and the cap when the cap is opened.

11. The device of claim 10, wherein the pair of flexible members are in a L-shaped configuration.

12. The device of claim 11, wherein the tab is a downward tab from the sidewall.

13. A device comprising:

a cap including a base and a sidewall;

a spout, the spout configured to engage the cap;

a retaining element secured with respect to the spout;

a tab connected to the sidewall; and a pair of non-linear flexible members connected to at least the retaining element, wherein at least rotation of the cap causes the pair of non-linear flexible members to rise and the tab to engage with a neck of the spout in a stay-back position.

14. The device of claim 13, wherein the tether mechanism further comprising:

a cutting mechanism configured to be in engagement with at least a camming mechanism included in the cap, wherein the camming mechanism engages the cutting mechanism to push through a seal.

15. The device of claim 13, wherein the pair of non-linear flexible members are connected to the tab, the tab is a radial tab extending from a junction including the pair of flexible members and the sidewall, the pair of flexible members converge and are connected at a same point to the retaining element, and the pair of flexible members are in a serpentine-type configuration.

16. The device of claim 13, wherein the pair of flexible members are connected to the tab, the tab is a downward tab from the sidewall, each flexible member is connected to a different portion of the retaining element, and the pair of flexible members are in a circumferential arc configuration.

17. The device of claim 13, wherein the pair of flexible members are connected to a different portion of the sidewall, the pair of flexible members are connected to a different portion of the retaining element, and the pair of flexible members are in a L-shaped configuration.

18. A device comprising:

a container;

a cap configured to open and close with respect to the container, the cap comprising a base, a sidewall and a camming mechanism on an internal side of the base and the sidewall;

a spout positioned on the container, the spout configured to engage the cap;

a cutting mechanism configured to be in engagement with at least the camming mechanism;

a retaining element secured with respect to the spout; and a tether mechanism connected to the retaining element and the sidewall of the cap, wherein at least rotation of the cap:

engages the camming mechanism with the cutting mechanism to push through a seal in the container; and causes the tether mechanism to rise and engage with a neck of the spout in a stay-back position.

19. The device of claim 18, wherein the tether mechanism further comprising:

a tab connected to at least the sidewall, the tab configured to engage the neck when the cap is opened.

20. The device of claim 19, wherein the tether mechanism further comprising:

a pair of flexible members connected to the tab and to the retaining element, the pair of flexible members configured to rise and provide distance between a mouth of the spout and the cap when the cap is opened.

* * * * *